United States Patent [19]

Divers

[11] 4,235,163

[45] Nov. 25, 1980

[54] MINE FACE VENTILATION SYSTEM

[75] Inventor: Edward F. Divers, Pittsburgh, Pa.

[73] Assignee: The United States of America as represented by the Secretary of the Interior, Washington, D.C.

[21] Appl. No.: 55,216

[22] Filed: Jul. 6, 1979

[51] Int. Cl.[3] ..... E21F 1/04

[52] U.S. Cl. ..... 98/50; 98/40 N; 239/523

[58] Field of Search ..... 98/40 C, 40 N, 50; 138/39, 109, 177, 178, DIG. 8, DIG. 11; 239/523, DIG. 7; 299/12

[56] References Cited

U.S. PATENT DOCUMENTS

| | | | |
|---|---|---|---|
| 1,173,801 | 2/1916 | Hess | 239/523 X |
| 3,289,567 | 12/1966 | Renner | 98/50 |
| 3,636,852 | 6/1972 | Burgess, Jr. | 98/50 |
| 3,712,678 | 1/1973 | Amoroso | 299/12 X |
| 4,055,112 | 10/1977 | Larkfeldt | 98/40 N X |

FOREIGN PATENT DOCUMENTS

| | | | |
|---|---|---|---|
| 154674 | 1/1954 | Australia | 239/DIG. 7 |

OTHER PUBLICATIONS

John B. Kebblish, "Face Ventilation and Dust Control with Continuous Mining Machines", *Mining Congress Journal*, Aug. 1959, pp. 34–38.

*Primary Examiner*—Albert J. Makay
*Assistant Examiner*—Harold Joyce
*Attorney, Agent, or Firm*—Thomas Zack; Donald A. Gardiner

[57] ABSTRACT

A mine face ventilating method and apparatus are disclosed which serve to supply fresh air from a ventilated crosscut. A duct system containing a blower draws air from the crosscut and expels a jet of air out of a duct in the tunnel. Arcuately shaped troughs located at the end of the duct in the tunnel channel the air to the face of the tunnel. The troughs define an arc of between about 90° and 180° and provide substantially improved air "throw" as compared with conventional tubular ventilation piping.

7 Claims, 3 Drawing Figures

MINE FACE VENTILATION SYSTEM

FIELD OF THE INVENTION

This invention relates generally to the ventilation of mine tunnels and more particularly to channeling ventilating air to the face of a tunnel using an open trough.

BACKGROUND OF THE INVENTION

During coal face operations, methane and respirable dust are generated both of which constitute serious safety and health hazards. The most effective technique for controlling these hazards has been to maintain adequate ventilation in the area of the mine face. One technique for doing this involves the use of tubular piping to provide the appropriate ventilation. For example, in U.S. Pat. No. 963,787 (Martin) and in U.S. Pat. No. 3,289,567 (Renner), mine ventilating systems are disclosed in which a conduit is used to direct air to the area of a mine face. Further, U.S. Pat. No. 3,919,930 (Yoskikawn et al) provides an air supply duct for a mine face on a movable carriage. Another conventional method of directing air to a mine face is through the use of brattice curtains. For example, U.S. Pat. No. 3,636,852 (Burgess, Jr.) discloses the provision of brattice curtains to create a flow path for ventilating air to the mine face.

While these prior art techniques have been generally successful, a number of disadvantages result from their use. One disadvantage of these methods is that the apparatus employed may take up too much room in a small tunnel and thus is likely to be damaged by the face equipment in the tunnel. Also, such systems are time consuming to set up. Further, as regards the brattice curtains, such curtains cannot be readily extended beyond the last roof bolts which thus limits their effectiveness.

Recent studies have indicated that a satisfactory ventilation system can be achieved by combining a blowing system and a machine mounted scrubber. This is especially true with recently developed "full face" machines and in situations where the mining machine penetrates more than twenty feet. However, blowing tubing used in conjunction with this technique is frequently too cumbersome and difficult to maintain and suffers the same disadvantages with regard to the amount of space occupied thereby.

SUMMARY OF THE INVENTION

In accordance with the present invention, a mine face ventilating method and apparatus are disclosed for providing ventilation air, preferably in combination with a system using blowing air and a machine operated scrubber to remove gases and dust from a mine tunnel. A duct system containing a blower draws air from a ventilated crosscut and expels a jet of air out of a duct in the tunnel. According to the principal feature of the invention, the jet of air from the duct is channeled along an arcuately shaped trough to the mine face. The arcuate trough is preferably formed by cutting out a sector of between about 90° to 180° from a length of circular tubing. In a preferred embodiment, the arcuately shaped trough is approximately one-third of a full circular tube, i.e., a 120° section and is attached to a tunnel wall at the intersection of the roof and rib with the convex portion of the trough against the rib and roof. Thus, the trough takes up very little room and does not interfere with the operation of face equipment in the tunnel. At the same time, the trough provides a very substantial increase in the air "throw", i.e., the amount of air delivered to mine face, as compared with a conventional rough rib mine wall.

Other features and advantages of the present invention are stated in or apparent from the detailed description of the preferred embodiment of the invention found hereinbelow.

DETAILED DESCRIPTION OF THE PREFERRED EMBODIMENT

Figure 1:
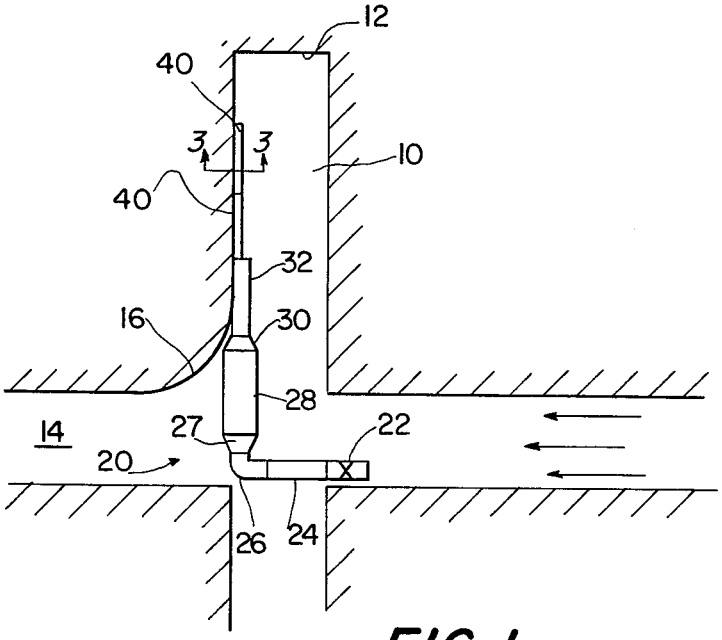
FIG. 1 is a schematic plan view of a mine tunnel incorporating the wall effect ventilation system of the present invention.

Referring to the drawings in which like numerals represent like elements throughout the several views, a presently preferred embodiment of the present invention is depicted in FIG. 1 as used in ventilating a tunnel 10 having a face 12. It will be appreciated that a tunnel such as tunnel 10 is normally difficult to ventilate because of the low height and because ventilating air must be drawn from the far side of a crosscut 14. Airflow through crosscut 14 is indicated by arrows and the rounded corner 16 of tunnel 10 is shaped to facilitate the movement of a conventional shuttlecar (not shown) into and out of tunnel 10.

A duct system 20, which is normally attached to the roof of the mine, is used to draw air from crosscut 14 and expel the air into tunnel 10. The duct system 20 includes a fan 22 which blows air into round tubing 24 having an elbow 26. From elbow 26, air passes into a transition section 27 which then leads into flat duct 28 having a small vertical thickness so as to provide extra clearance for shuttlecars and other machines passing therebeneath. Another transition section 30 on the other side of flat duct 28 leads the air into another section of round tubing 32.

Figure 3:
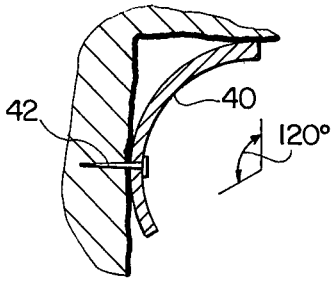
FIG. 3 is a cross-sectional view of the trough of the invention taken generally along line 3—3 in FIG. 1.
Figure 2:
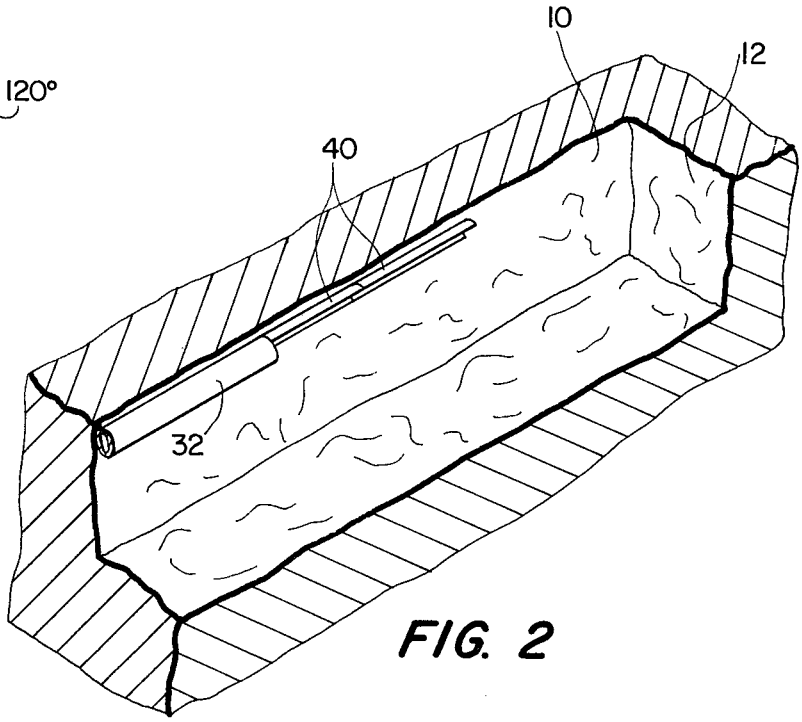
FIG. 2 is a schematic perspective view showing a trough of the present invention in place of a mine tunnel.

In accordance with the present invention, one or more arcuate troughs 40 are positioned at the end of the round tubing 32 so as to increase the flow of the air expelled through the tubing 32. In order to have troughs 40 take up as little space in tunnel 10 as possible, troughs 40 are attached by spads 42, or other suitable fasteners at the intersection of the rib and roof of tunnel 10, as shown in FIG. 3.

In operation, the wall effect ventilation system of the invention functions in the following manner. When ventilating is required in tunnel 10, fan 22 is activated and air is drawn into duct system 20 from crosscut 14 and blown through duct system 20 and out of round tubing 32 in a jet. Generally, round tubing 32 consists of one ten foot section extending into tunnel 10. The jet of air expelled from round tubing 32 is channeled along troughs 40 towards face 12 of tunnel 10. The air is channeled along troughs 40 due to the so-called "wall effect", which is similar to the "Coanda effect", whereby a continuous jet of air adheres to a smooth (concave) surface such as the concave portion of troughs 40. Troughs 40 extend along the walls of tunnel 10 to a point which is approximately opposite to the position of the operator working mine face 12. In cooperation with a machine mounted scrubber (not shown), the wall effect ventilation system ventilates tunnel 10 while mine face 12 is being mined. As tunnel 10 is extended, additional troughs 40 can be readily attached to troughs already in place so as to channel air to the advancing mine face 12.

A convenient source of the troughs 40 is standard rigid mine ventilation tubing with a 14 to 24 inch diameter which are cut into sections to form the arcuate troughs. Experiments have shown that troughs 40 should form an arc of between 90° and 180°. Where the arc sections are less than 90°, a significant reduction in air channeling is observed, whereas when the arc sections are greater than 180°, these sections begin to interfere with the operation of mine face equipment just like full round sections. A convenient size is 120° arc, as shown in FIG. 3, in that, inter alia, this size section is easily made by cutting a round tube into three equal sections.

As noted above, the arcuate troughs of the present invention provide a substantial increase in the throw of air over conventional techniques. In this regard, tests have shown that at 4,000 cfm with a 14 inch diameter round duct tube and a 180° arc trough cut from an 18 inch diameter tubing, air channeling over a thirty foot distance is increased two-and-one-half times compared to air thrown along a rough rib.

Although the invention has been described in detail with respect to exemplary embodiments thereof, it will be understood by those of ordinary skill in the art that variations and modifications may be effected within the scope and spirit of the invention.

I claim:

1. An apparatus for supplying ventilating air to the working face of an underground mine tunnel, said apparatus comprising:

a closed duct air conduit system extending from a ventilated mine crosscut to the mine working tunnel;

an air blower operatively associated with said duct system for forcing air into said duct system from the crosscut causing air to be expelled in a jet from the end of said duct system located in the working tunnel;

a trough arcuately shaped in opened cross-section connected to said duct system at one end and extending along the working tunnel towards the face of the tunnel, said trough's opened side being away from the most adjacent mine wall and said trough being located at the end of said duct system to provide that the jet of air which is expelled from said duct system is channeled to the working face of the tunnel along said trough.

2. An apparatus for supplying ventilating air as claimed in claim 1, wherein said trough is located along a wall of the tunnel and is affixed to said wall.

3. An apparatus for supplying ventilating air as claimed in claim 2, wherein said trough is attached to the wall of the tunnel with the convex surface of said trough bearing against the tunnel wall.

4. An apparatus for supplying ventilating air as claimed in claim 3, wherein said trough is attached to the tunnel wall at the location substantially at the intersection of the rib and roof of the tunnel.

5. An apparatus for supplying ventilating air as claimed in claim 1, wherein the arc of said trough is between 90° and 180°.

6. An apparatus for supplying ventilating air as claimed in claim 5, wherein the arc of said trough is about 120°.

7. An apparatus for supplying ventilating air as claimed in claim 1, wherein at least one additional trough is attached to the end of the first-mentioned trough in axial relation thereto so that air channeled along the first-mentioned trough is also channeled along at least one additional trough.

* * * * *